United States Patent [19]

Tolleson

[11] 4,159,846

[45] Jul. 3, 1979

[54] TABLET ARM FOR WIRE ROD CHAIR

[75] Inventor: Thomas H. Tolleson, Green Bay, Wis.

[73] Assignee: Krueger Metal Products, Inc., Green Bay, Wis.

[21] Appl. No.: 920,916

[22] Filed: Jun. 30, 1978

[51] Int. Cl.[2] ..... A47B 39/00; E05D 11/04

[52] U.S. Cl. ..... 297/162; 16/136

[58] Field of Search ..... 297/160, 161, 162; 16/136, 171, 149

[56] References Cited

U.S. PATENT DOCUMENTS

| | | | |
|---|---|---|---|
| 518,130 | 4/1894 | Bartol | 297/162 X |
| 1,093,686 | 4/1914 | Cogger | 297/162 |
| 2,711,210 | 6/1955 | Henrikson | 297/162 |
| 2,717,632 | 9/1955 | Morse | 297/162 |
| 3,194,600 | 7/1965 | Junkunc | 297/160 |
| 3,261,641 | 7/1966 | Black et al. | 297/162 |
| 3,295,158 | 1/1967 | Hotchkiss, Jr. et al. | 16/136 X |
| 3,368,842 | 2/1968 | Polsky | 297/162 |
| 3,921,225 | 11/1975 | Suska | 16/136 |

*Primary Examiner*—Roy D. Frazier
*Assistant Examiner*—Peter A. Aschenbrenner
*Attorney, Agent, or Firm*—Wheeler, Morsell, House & Fuller

[57] ABSTRACT

A tablet arm attachment for a chair includes brackets with U-shaped channels and outwardly extending flanges to clamp the tablet arm to a support rod from which the tablet arm to a support rod from which the tablet arm is pivoted. A molded plastic bearing insert has a U-shaped channel portion complementary to the channel portion of the brackets to interfit therewith. A flap on the bearing insert permits the bearing insert to be folded over the support rod and provides a smooth, quiet, pivotal motion of the tablet arm which will not scratch the tablet arm.

3 Claims, 5 Drawing Figures

TABLET ARM FOR WIRE ROD CHAIR

BACKGROUND OF THE INVENTION

Chairs with folding tablet arms typically employ U-shaped brackets to fasten the tablet arm to the pivot post. U.S. Pat. Nos. 3,194,600 and 3,261,641 are illustrative of the use of such brackets. Use of a U-shaped bracket enables assembly of the tablet arm on a welded, integrated framework after the framework has been assembled. However, cylindrical bearings on the tablet arm cannot be employed in a later assembly operation because the ends of the tubular rod or tubing are no longer accessible or, because of bends in the rod or tubing, the cylindrical bearings for a pivot cannot be moved into position. The U-shaped brackets and the rod or tubing support posts are both typically made of metal and thus there is metal to metal contact which does not provide a smooth, silent pivoting action of the tablet arm when it is moved from the generally horizontal position for use to a folded position for ingress and egress of the seat occupant.

SUMMARY OF THE INVENTION

The invention provides a molded plastic insert bearing for a U-shaped mounting clamp which can be assembled after the fabrication of the rod or tubing support framework is completed. The bearing insert has a U-shaped channel portion which is complementary in shape to the U-shaped channel portion of the bracket so that it will interfit therewith. A mounting lug on the bearing insert fits in a slot in the base of the channel to positively position the bearing insert in place. A flap is integrally formed with the U-shaped channel portion and is hinged to the channel portion by a plastic web which enables the flap to be spread to snap the channel portion over the support rod and then closed to be pressed flush against the bottom of the tablet arm as the brackets are secured to the tablet arm.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
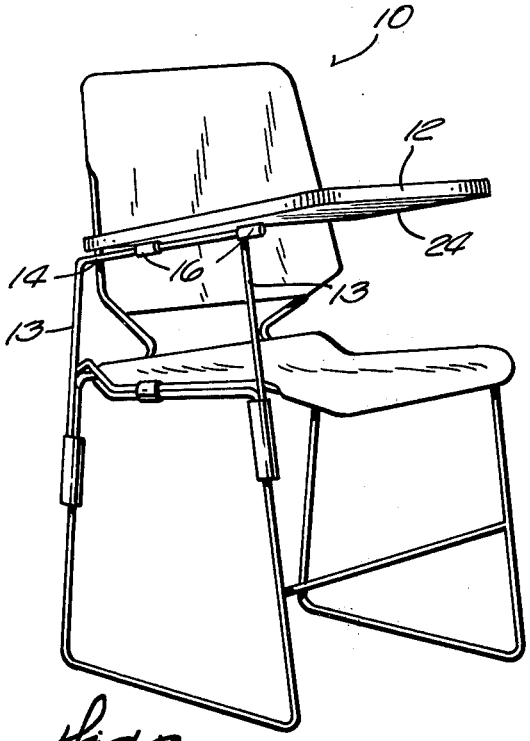
FIG. 2 is a perspective view of a chair embodying the bearing inserts of the invention.
Figure 3:
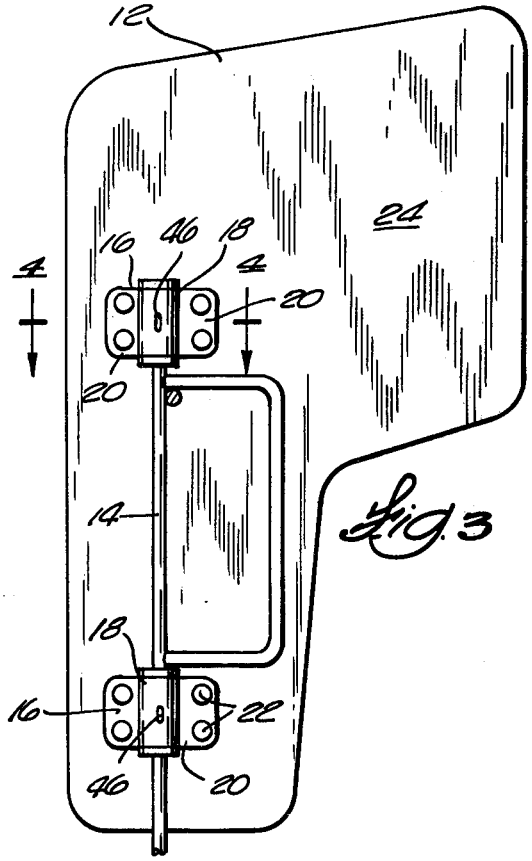
FIG. 3 is an enlarged view of the undersurface of the tablet arm shown in FIG. 2.

FIG. 2 shows a wire rod chair 10 which includes a tablet arm assembly 12. The tablet arm assembly includes struts 13 which clip onto the chair frame and a table arm support post 14 about which the tablet arm can pivot from the position shown in FIG. 2 to a vertical position to permit egress and ingress with respect to the chair. The tablet arm is secured to the post 14 by brackets 16 which have elongated U-shaped channel portions 18 with outturned flanges or wings 20 provided with apertures 22 for fasteners to secure the brackets to the undersurface 24 of the tablet arm 12.

Figure 4:
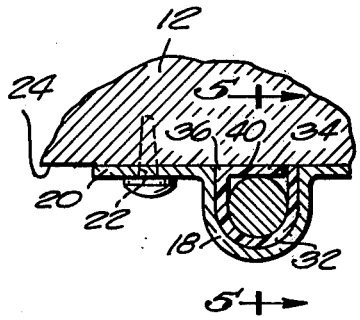
FIG. 4 is a sectional view along line 4—4 of FIG. 3.
Figure 1:
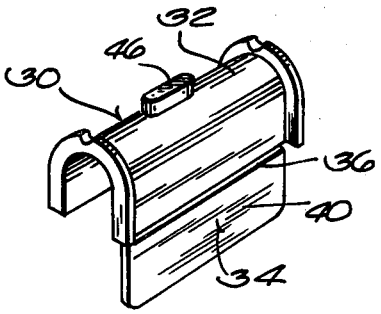
FIG. 1 is a perspective view of the bearing insert of the invention.
Figure 5:
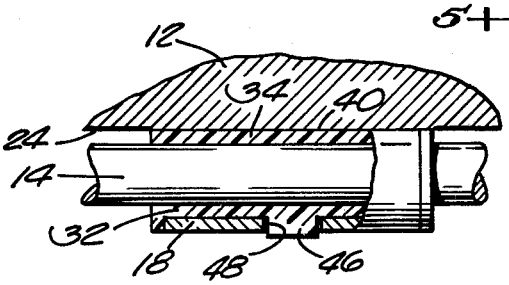
FIG. 5 is a fragmentary sectional view along line 5—5 of FIG. 4.

In accordance with the invention, there is provided a bearing insert for the channel 18. The bearing insert 30 (FIG. 1) has an elongated curved channel portion 32 which has a curvature complementary to that of the channel portion 18, as illustrated in FIG. 4, to interfit therewith. To provide a bearing surface of plastic completely surrounding the support post 14, the bearing insert is provided with a flap 34 which is integrally molded therewith. The flap 34 is hinged to the cylindrical portion 32 by a thin web portion 36 which enables the flap to be opened and closed over the support rod as illustrated in FIG. 4, with the surface 40 of the flap abutting the undersurface 22 of the tablet arm.

To positively position the bearing insert in the bracket, an insert is provided with a projection 46 which interfits in a slot 48 in the bottom of the channel 18.

What is claimed is:

1. In a tablet arm attachment for a chair including a tablet arm, support rod and depending struts for securing the attachment to a chair, the improvement comprising means to clamp the tablet arm to said support rod to afford rotational movement of the tablet arm between first and second positions, said means comprising a bracket having an elongated U-shaped channel with outwardly projecting mounting flanges, a flexible bearing insert, said bearing insert including a circular wall portion sized to interfit in said channel, a flap portion hingedly connected to said circular wall portion and movable between an open position permitting insertion of said bearing insert over said support rod and a closed position in which said bearing portion encapsulates said support rod and said flap being flush with said tablet arm when said bracket is secured to said tablet arm.

2. The improvement of claim 1 wherein said U-shaped channel has a slot and a projection on said bearing insert registrable with said slot to positively position said bearing insert in said slot.

3. The improvement of claim 1 wherein said bearing insert is molded from plastic and said flap is connected to said circular portion at a juncture having a thickness less than the thickness of said flap and said circular wall portion to afford bending of said flap between said open and closed positions.

* * * * *